United States Patent [19]

Kummerlin et al.

[11] 4,210,224

[45] Jul. 1, 1980

[54] LONGITUDINALLY VARIABLE LADDER

[76] Inventors: Walter Kümmerlin, In den Fressäckern, D-7120 Bietigheim-Bissingen; Nikolaus A. Kümmerlin, Humboldstrasse 26, D-7220 Schwenningen, both of Fed. Rep. of Germany

[21] Appl. No.: 1,338

[22] Filed: Jan. 5, 1979

[51] Int. Cl.[2] ..... E06C 1/22; E06C 7/06

[52] U.S. Cl. ..... 182/207; 182/23; 182/166

[58] Field of Search ..... 182/207, 208, 209, 210, 182/211, 212, 213, 166

[56] References Cited

U.S. PATENT DOCUMENTS

| | | | |
|---|---|---|---|
| 470,515 | 3/1892 | Skeels | 182/209 |
| 697,294 | 4/1902 | Totman | 182/208 |
| 1,461,952 | 7/1923 | Walchli | 182/209 |
| 2,210,803 | 8/1940 | Dunn | 182/213 |
| 3,692,143 | 9/1972 | Kummerlin | 182/207 |

*Primary Examiner*—Reinaldo P. Machado
*Attorney, Agent, or Firm*—Martin A. Farber

[57] ABSTRACT

A longitudinally variable ladder with at least two ladder parts which are displaceable relative to one another in their longitudinal direction, one part of which with its two struts forms a guide for the struts of the other part, which latter struts engage between the former struts, and the rungs, which are connected with the outer struts, lie on the front side of these struts, the rungs which are connected with the inner struts lying between the two planes which are defined by the front side and the rear side of these struts. The struts of all ladder parts have the same box profile, and the inner struts are guided between at least those two rungs of the outer struts which lie in the upper end section of these struts, from which upper end section the other ladder part is able to be pulled out, and guide rails, the guide rails being limited to the end section which carries the two rungs and in this end section at least indirectly engage on the rear side of the outer struts.

9 Claims, 5 Drawing Figures

Fig.3
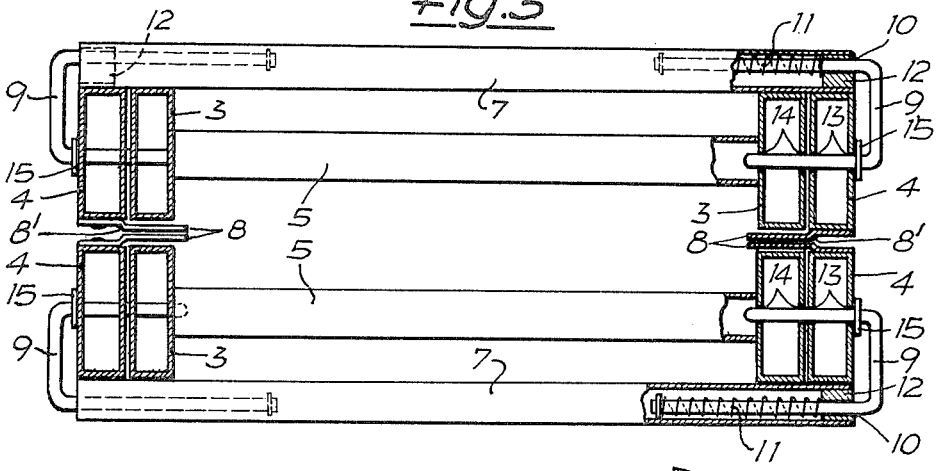
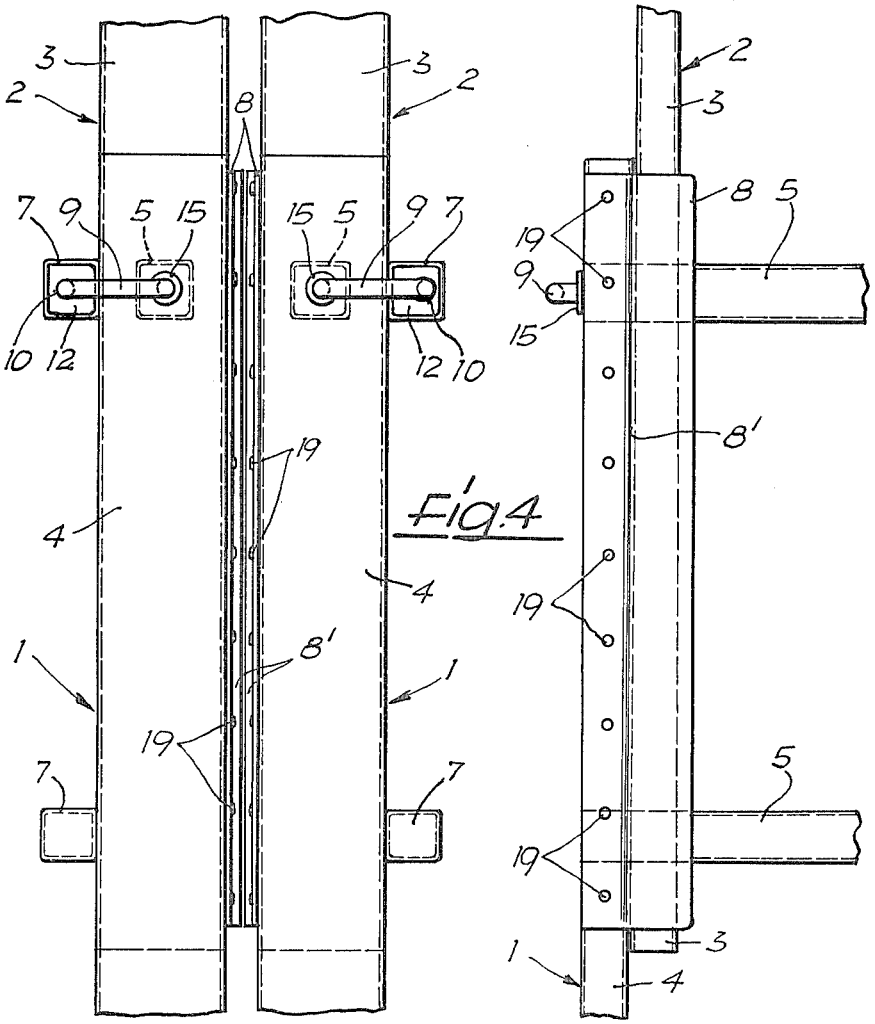
Fig.4

LONGITUDINALLY VARIABLE LADDER

The invention relates to longitudinally variable ladder with at least two ladder parts which are displaceable relative to one another in their longitudinal direction, of which parts one part with its two struts forms a guide for the struts of the other part, which latter struts engage between the former struts, and the rungs, which are connected with the outer struts, lie on the front side of these struts, and the rungs which are connected with the inner struts lie between the two planes which are defined by the front side and the rear side of these struts.

With the known ladders of this type the outer struts have a U-profile, whereby the two legs of the profile form the guide surfaces for the front side and rear side of the inner struts. The inner struts are consequently not only laterally guided on the entire length of the section which lies between the outer struts, but also are guided forwardly and rearwardly, which causes a relatively large friction. Moreover with U-profile struts either one must endure the danger of a deformation by impacts or pressure on the profile-legs or one must select a relatively large wall thickness of the U-profile which considerably increases the weight of the ladder and the costs. U-profile struts also cause high manufacturing costs since the rungs can not be fastened with a rivet, but rather must be welded together, and in this case again and again breaking through the strut wall occurs. As far as the outer struts are bent outwardly in the area of their lower end section, in order to achieve a higher stability under load, an over-sizing or over-dimensioning of the U-profile is also required in order to prevent a buckling of the set-out foot ends.

It is an object of the present invention to create a longitudinally adjustable ladder, which in spite of a small weight is considerably insensitive to impact and pressure, nevertheless can be manufactured economically.

It is another object of the present invention to aid the solution of the above-mentioned task with a longitudinally changeable ladder of the introductory-mentioned type in the manner that the struts (3, 4) of all ladder parts (1, 2) have the same box profile, and the inner struts (3) are guided between at least those two rungs (7) of the outer struts (4) which lie in the upper end section of these struts, from which upper end section the other ladder part (2) is able to be pulled out, and guide rails (8), the guide rails being limited to the end section which carries the two rungs (5) and in this end section at least indirectly engage on the rear side of the outer struts (4).

The friction between the ladder parts which are displaceable relatively to one another is small, since the front and rear sides of the inner struts only can come into engagement on the rungs of the outer struts and on the very short guide rails in the displacement direction. Moreover the parts forming the guide need not be comparatively heavy to avoid a clamping or jamming of the guide, since with rungs the danger of a deformation is very small, the profiles provided for the struts, thus tubes with rectangular cross-section, even with small wall thickness have a high stability of form and the guide rails due to their small length also have a low weight even with a relatively large thickness. The guide rails, which could even run parallel to the rungs, preferably however extend in the longitudinal direction of the struts, and can be fastened with a rivet on the struts.

However not only this economical connection, but also the fact that all struts have the same profile, the rungs even being used as guide elements for the inner struts and a welding together of the rungs on the box-profile providing no difficulties, leads to favorable and desirable production costs.

Finally it is still of advantage that the same box profile for all struts leads to the minimum ladder weight, since none of the struts need to be oversized.

With one preferred embodiment the guide rails (8) extend in the longitudinal direction of the struts (4) which carry them and project inwardly over these struts, preferably to an extent corresponding approximately to the dimension of the struts (3, 4) in the longitudinal direction of the rungs (5, 7). In this manner on the one hand a good guiding is achieved and on the other hand the weight and the material expense for the guide rails is held to a minimum.

In order to be able to lay the guide rails directly against the struts carrying them and nevertheless to make possible a sufficient play between them and the inner struts (3), the guide rails in advantageous manner are provided with an offset or bend (8') toward the rear, which offset provides the necessary play.

If the ladder is such with two identically formed legs, the legs each being made of two ladder parts, which ladder parts are displaceable relative to one another in their longitudinal direction until the separation, the legs being connected with one another on their one end by means of two articulations, and which has U-shaped locking brackets which serve for the locking of the ladder parts (which parts are displaceable to one another) in the area of the upper end section of both outer struts, one leg of the locking brackets being displaceably guided in the longitudinal direction of the rungs against the force of a restoring spring in the uppermost rung of the ladder part with the outer struts, and a bore which goes through the strut being coordinated to the other leg of each locking bracket, in a simple manner one can form two working supports or frame stands, for example, for the construction of a working platform or scaffold in the following manner. The two ladder parts (1) with the outer struts are connected with each other with the aid of two of the fastening brackets (9). Consequently in this manner the spacing of the guide bore of each locking bar bracket (9) in the uppermost rung from the bore (13) (which bore penetrates the strut (4)) of the other ladder part (1) with a double-ladder like positioning of these two ladder parts is chosen corresponding to the spacing of the legs of the locking brackets from each other. In a particularly simple manner these spacings can be achieved in the manner that the guide bore is arranged off-center in the rung, thus the spacing of the leg (which is guided in the rung) from the front side of the rung is chosen smaller than its spacing from the rear side of the rung, which rear side of the rung engages on the strut.

With such a formation of two working supports, in order for the other ladder part which is held by the locking brackets of one ladder part to be secured to a sufficient degree against a displacement relative to said one ladder part in the longitudinal direction of the rungs, preferably an abutment (15) engaging on the outside of the strut with maximum penetration depth is provided on that leg of the locking brackets (9) which leg is able to be inserted in the bore (14) of the strut (3). The abutment preferably is in the form of an annular collar or band.

With the above and other objects and advantages in view, the present invention will become more clearly understood in connection with the detailed description of a preferred embodiment, when considered with the accompanying drawings, of which:

FIG. 3 is a cross-section of the embodiment in the folded up condition;

FIG. 4 is a broken away, incompletely illustrated side view according to FIG. 3, and a view of the rearside of one of the two equally formed legs of the embodiment example.

Figure 2:
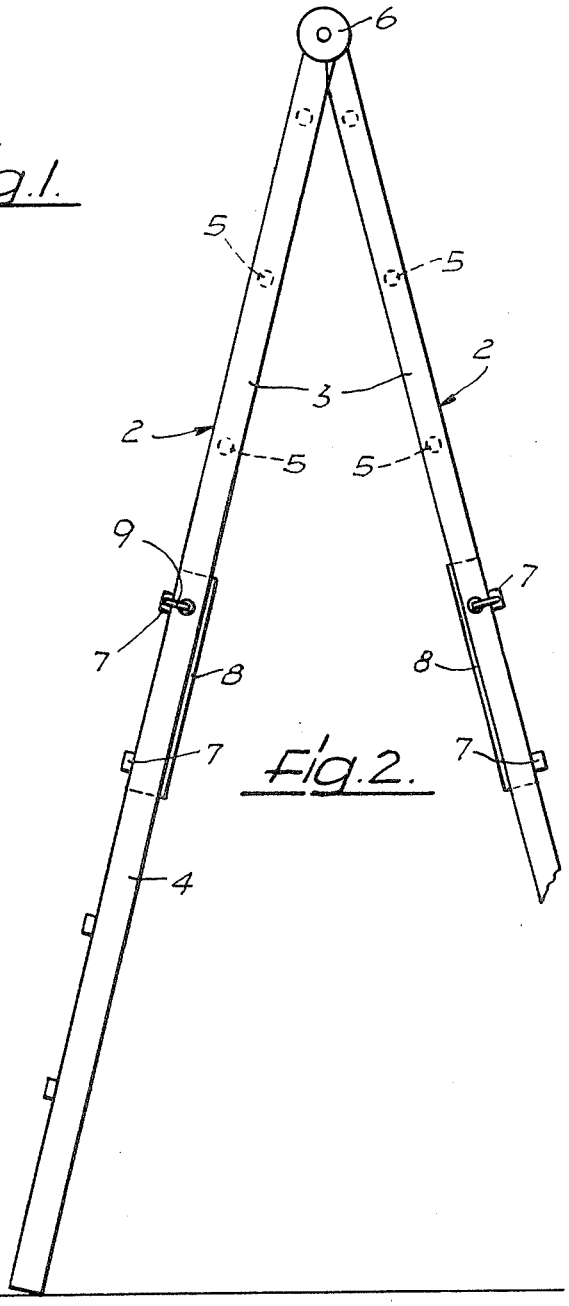
FIG. 2 is a side view of the embodiment of FIG. 1 for use as a trestle or double-ladder (i.e., an upside down V-shaped ladder)

Referring now to the drawings, a longitudinally adjustable ladder in accordance with the invention, as particularly shown in FIG. 2, includes two identically formed legs, each of which has a lower ladder part 1 and an upper ladder part 2.

As FIG. 3 shows, not only do the two struts 3 of the upper ladder parts 2 have a box-profile, but also the two struts 4 of the lower ladder parts 1 have a box-profile, and indeed they have a box-profile of identical dimensions. All struts 3 and 4 are produced in the embodiment example from a rectangular or square aluminum tube, although not limited thereto.

The struts 3 (which are parallel to one another) of each of the two upper ladder parts 2 are connected with one another by means of rungs 5. As FIG. 3 shows these rungs 5 lie in the center between those two planes which are defined by the front side and the rear side of the struts 3. The upper end of the struts 3 of one leg of the ladder is connected with the upper end of the struts 3 of the other leg of the ladder, respectively by means of one articulation fitting 6 each. The articulation fittings 6 permit a clamping or arresting of the ladder legs in different relative angular positions, including a locking at the pivot angle of 180°, which is possible for use of the ladder as an engagement ladder (i.e. a straight ladder for leaning against a wall).

Figure 1:
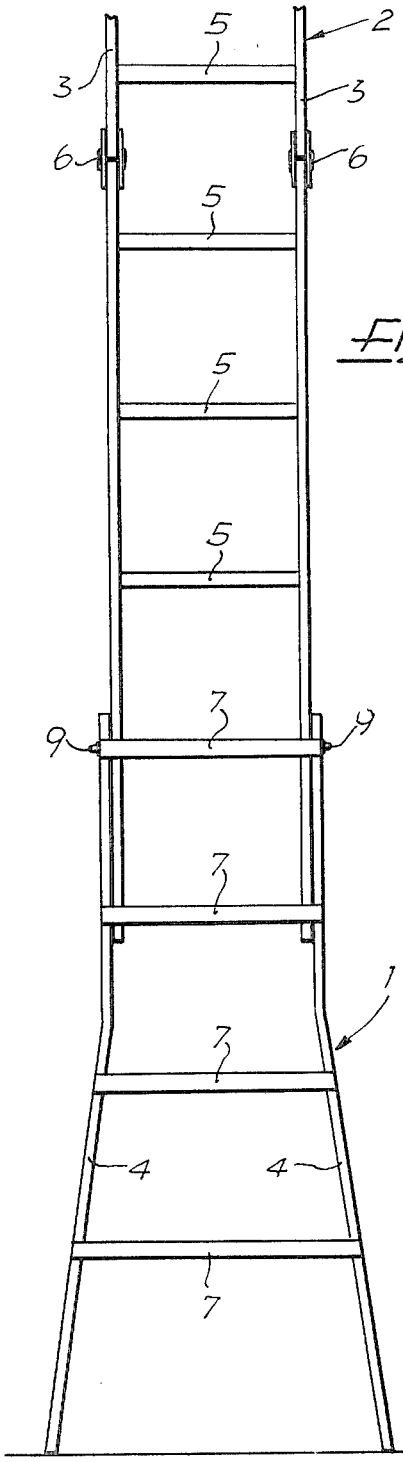
FIG. 1 is a front elevational view of one embodiment example of the invention with a maximum length of the ladder.

The struts 3 of the upper part 2 of the ladder of each leg of the ladder lie with sufficient play between the struts 4 of the associated and coordinated lower ladder part 1 as shown in FIG. 3. The rungs 7 engage on the front side of the struts 4. The rungs 7 are made in the embodiment example likewise of a rectangular or square - aluminum tube and the rungs are welded together with the struts 4. The number of the rungs, which are spaced from one another, are equal to the number and spacing of the rungs 5. The rungs 7 form the front guide elements for the inner disposed struts 3, whereby in the first place the two uppermost rungs serve to guide the struts 3, since the struts 3 find support or abutment on them even when the ladder is adjusted to its maximum length, as shown in FIG. 1.

For the rear-side guiding of the struts 3, two equally formed guide rails 8 are provided. These guide rails extend in the longitudinal direction of the struts 4 approximately from the two uppermost rungs 7 up to the upper end of the struts 4 and engage directly on the rear side of the struts 4. In the embodiment example the guide rails 8 are connected with the struts 4 by rivets 19, as shown in FIG. 4. As FIGS. 3 and 4 show, the guide rails 8 project beyond the inner side of the struts 4 to an extent which corresponds approximately to the width of the struts 3 measured in the longitudinal direction of the rungs 5. So that a sufficient play is provided between the guide rails 8 and the struts 3, where the projection begins the guide rails 8 are provided with an offset or rear- and inward- bend resulting in a displacement toward the rear. The guide rails 8 likewise are made of aluminum and have such a large thickness that usually occurring impacts, shocks or jolts or pressure strains cannot lead to a deformation and consequently a clamping or jamming of the struts 3.

In order to improve the stability or steadiness of the ladder, the struts 4 of the lower ladder part 1 of both of the ladder legs are bent outwardly to the same extent in the area between the two upper and the two lower rungs 7.

In order to be able to positively connect, without friction or slipping, the upper ladder part 2 with the lower ladder part 1 in both displacement directions, in the position of minimum ladder length, in the position of maximum ladder length and under circumstances in one or more intermediate positions, there are provided four equally formed U-shaped locking or fastening brackets or yokes 9. The uppermost rung 7 of each of the two lower ladder parts 1 is formed on its both ends with one guide bore 10 each, which bore, as shown in FIG. 3, is arranged closer to the front side then to its rear side, which rear side engages on the struts 4. One leg of the associated and coordinated locking yoke 9 is rotatably and longitudinally displaceably guided in the guide bore 10. A readjusting or return spring 11 which surrounds one of these legs is supported on the one side on a disc which is fastened to the end of the leg and on the other side it is supported on the insert body 12, the latter being inserted in the rung and having the guide bore therein.

At the level of the uppermost rung 7, the two outer struts 4 are each centrally penetrated by respectively a bore 13. Likewise, bores 14 which lie at the level of the rungs 5 and which centrally penetrate the inner struts 3, are able to be aligned with the bores 13. In the aligned condition of these bores, the free legs of the locking brackets 9 penetrate the bores 13 and 14, and in this manner connect the upper ladder part 2, positively and without slipping, with the lower ladder part 1. With maximum penetration depth of this leg of the locking yokes 9, which is illustrated in FIG. 3 an abutment disc 15 (which is rigidly arranged on this leg) engages against the outer side of the associated strut 4.

Those bores 14 which are located at the smallest distance from the lower end of the inner struts 3 are arranged such that with a maximum withdrawal of the upper ladder part 2 from the lower ladder part 1, the lower end of the struts 3 still can engage or abut against the second uppermost rung 7 of the lower ladder part 1, as this is shown in FIGS. 1 and 2.

Figure 5:
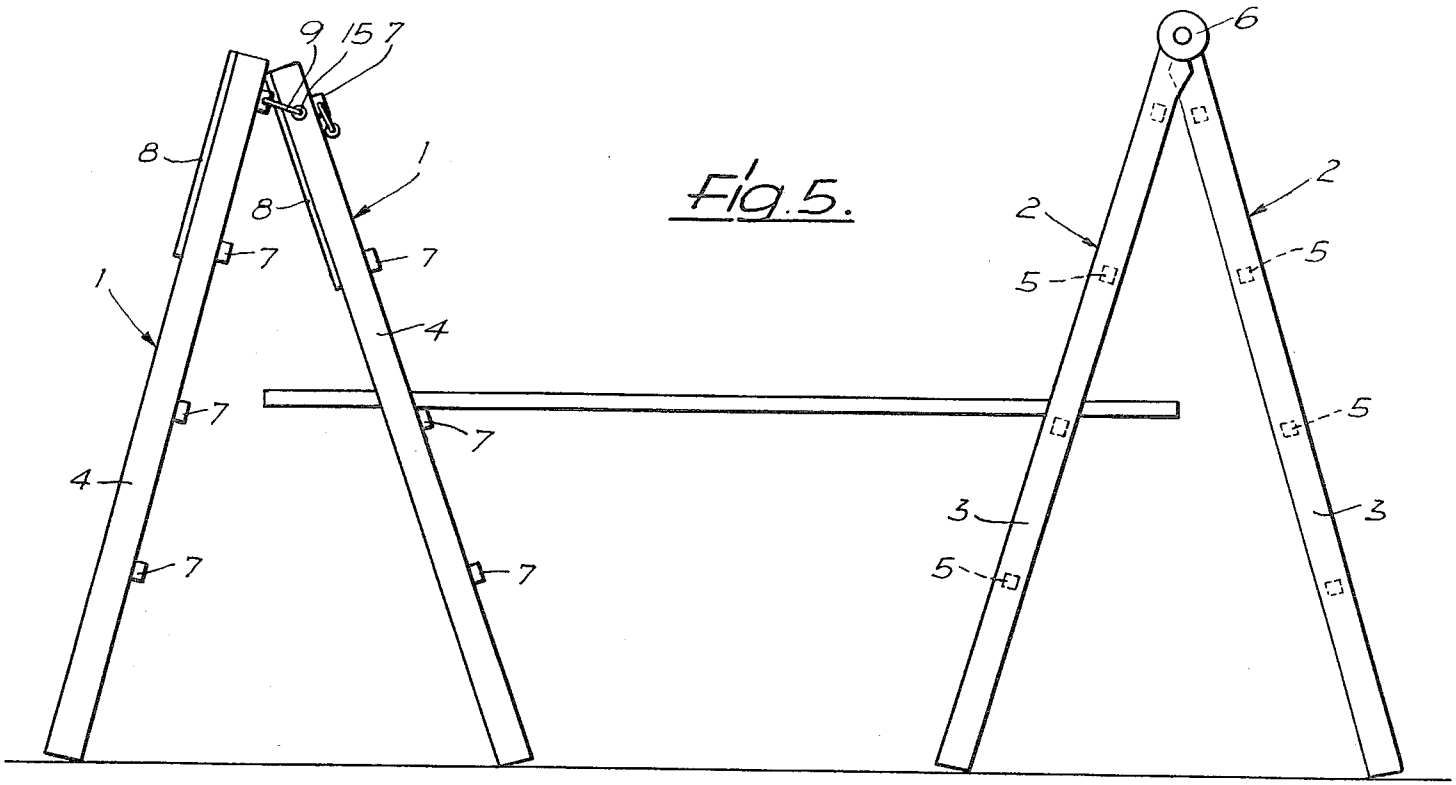
FIG. 5 is a side view of a working platform or scaffold which is formed with the aid of the embodiment example.

In so far as two working supports or trestles are supposed to be made from the ladder, as FIG. 5 shows, one working support is formed by both of the upper ladder parts 2, and the other working support is formed by the two lower ladder parts 1. The latter for this purpose by formation of an acute angle therebetween are positioned on each other such that the guide rails 8 of one part come into engagement or abutment on the uppermost rung of the other part. In this position, which is illustrated in FIG. 5, the free legs of both of the fastening brackets 9 of that ladder part 1 on the uppermost rung of which the other ladder part engages, are inserted in the two bores 13 of the struts 4 of the other ladder part. The abutment discs 15 in this case engage on the outer side of these struts 4 so that they are held not only connection with the struts of the other ladder part 1, but also to a sufficient extent are prevented from shifting in the longitudinal direction of the rungs relative to the other ladder part.

While we have disclosed one embodiment of the invention it is to be understood that these embodiments are given by example only and not in a limiting sense.

We claim:

1. A longitudinally variable ladder with at least two ladder parts which are displaceable relative to one another in their longitudinal direction, comprising ladder parts each including two longitudinal struts and rungs connected therebetween, a first of said ladder parts with first of said two longitudinal struts thereof forms a guide for second of said struts of a second of said ladder parts, said second struts constituting inner struts engaging between said first struts, and first of said rungs of said first ladder part being connected with said first struts on a front side of said first struts, the latter constituting outer struts and being disposed outside of said second struts, second of said rungs of said second ladder part being connected with said inner struts and lying between two planes, said two planes being defined by a front side and a rear side of said inner struts, respectively, guide rails being operatively connected to said outer struts, said struts of all said ladder parts have the same box-shaped profile, said inner struts being guided between at least two of said first rungs of said outer struts and said guide rails, said at least two first rungs being fastened on an upper end section of said outer struts, said second ladder part being withdrawable from said upper end section, said guide rails being limited to the end section carrying the two rungs, said guide rails at least indirectly engage on the rear side of said outer struts in said end section.

2. The ladder as set forth in claim 1, wherein said guide rails extend in the longitudinal direction of said outer struts carrying them and project inwardly beyond said outer struts.

3. The ladder as set forth in claim 2, wherein said guide rails project inwardly beyond said outer struts by a distance substantially equal to a dimension of said struts in the longitudinal direction of said rungs.

4. The ladder as set forth in claim 2, wherein said guide rails directly engage on said outer struts and have a bend section means projecting toward the rear, said bend section means for providing a necessary play for said inner struts.

5. The ladder as set forth in claim 1, comprising two identically formed ladder legs, each of said legs is made of said first and said second ladder parts, two articulations connecting said two ladder legs with one another on one end, a plurality of U-shaped locking brackets constituting means for locking said first and said second ladder parts in the vicinity of said upper end section of both said outer struts, an uppermost of said outer rungs of said first ladder part is formed with guide bores, restoring springs are disposed in said guide bores in said uppermost rung of said first ladder part, each said locking bracket has a first bracket leg, the latter is displaceably guided in said guide bore of said uppermost rung in the longitudinal direction of said rungs against the force of said one of said restoring springs, said inner struts are formed with first bores, said outer struts are formed with second bores extending therethough, each said locking brackets has a second bracket leg rearwardly insertable in said first and second bores, said first and said second ladder parts are displaceable relative to one another in their longitudinal direction up to separation thereof, two of said locking brackets connect both said first lladder parts of said first and said second ladder legs to each other in a double-ladder arrangement of both said first ladder parts, the spacing of said first bracket leg from said second bracket leg of each said locking brackets as well as the spacing of said guide bores in said uppermost rung of one of said first ladder parts from said second bores of the other of said first ladder parts in the double-ladder arrangement of both of said first ladder parts being so as to permit connection of both of said first ladder parts by said two locking brackets with said first bracket legs thereof disposed in said guide bores of said one of said first ladder parts and said second bracket legs thereof inserted in said second bores of said other of said first ladder parts.

6. The ladder as set forth in claim 5, wherein the distance of said first bracket leg from the front side of said uppermost rung is less than the distance of said first bracket leg from the rear side of said uppermost rung, said rear side of said first rungs engages said outer struts.

7. The ladder as set forth in claim 5, further comprising an abutment mounted on said second bracket leg of each said locking brackets abuts an outside of said outer struts with a maximum penetration depth of said second bracket leg in one of said second bores of said outer struts.

8. The ladder as set forth in claim 7, wherein said abutment has the shape of an annular band.

9. The ladder as set forth in claim 5, wherein said locking brackets each are bars having a U-shape.

* * * * *